United States Patent [19]

Yoshikawa et al.

[11] Patent Number: 4,937,630

[45] Date of Patent: Jun. 26, 1990

[54] IMAGE FORMING APPARATUS EMPLOYING NON-MAGNETIC AND MAGNETIC TONER

[75] Inventors: Masao Yoshikawa, Tokyo; Kimio Nakahata, Kawasaki, both of Japan

[73] Assignee: Canon Kabushiki Kaisha, Tokyo, Japan

[21] Appl. No.: 127,763

[22] Filed: Dec. 2, 1987

[30] Foreign Application Priority Data

Dec. 10, 1986 [JP] Japan ..... 61-292456
Feb. 25, 1987 [JP] Japan ..... 62-40450

[51] Int. Cl.[5] ..... G03G 15/14

[52] U.S. Cl. ..... 355/273; 355/245; 355/271; 355/326; 430/45

[58] Field of Search ..... 355/14 D, 14 CH, 4, 355/3 CH, 14 TR, 3 DD; 430/126, 45, 47, 100

[56] References Cited

U.S. PATENT DOCUMENTS 4,308,821 1/1982 Matsumoto et al. ..... 355/4 X
4,395,476 7/1983 Kanbe et al. ..... 355/3 DD X
4,416,533 11/1983 Tokunaga et al. ..... 355/4
4,443,095 4/1984 Tsushima et al. ..... 355/4 X
4,539,281 9/1985 Tanaka et al. ..... 430/45
4,634,259 1/1987 Oishi et al. ..... 355/4
4,660,961 4/1987 Kuramoto et al. ..... 355/4

FOREIGN PATENT DOCUMENTS 37148 of 1973 Japan .
54-81855 of 1979 Japan .
55-137538 of 1980 Japan .
144452 11/1981 Japan .

*Primary Examiner*—A. T. Grimley
*Assistant Examiner*—Robert Beatty
*Attorney, Agent, or Firm*—Fitzpatrick, Cella, Harper & Scinto

[57] ABSTRACT

An image forming apparatus employs a non-magnetic developing agent and a magnetic developing agent which have been charged to opposite polarities to develop at least first and second latent images formed on an image carrier in response to image information, thus forming first and second developed images. The first and second developed images are charged to the same polarity as that of the magetic developing agent, prior to the transfer onto a transfer medium so as to provide a vivid transferred image.

26 Claims, 4 Drawing Sheets

IMAGE FORMING APPARATUS EMPLOYING NON-MAGNETIC AND MAGNETIC TONER

BACKGROUND OF THE INVENTION

1. Field of the Invention

The present invention relates to an image forming apparatus, and, more particularly, to an image forming apparatus in which at least two latent images formed on an image carrier are developed by two different types of developing agents which are charged to opposite polarities and the developed images are transferred onto a transfer medium so as to form a visible image. More specifically, the present invention concerns an image forming apparatus which is capable of forming an image in two colors using two developing agents.

2. Description of the Prior Art

Conventionally, printers which are used as terminals in information devices such as computers, facsimiles, or CAD's have been of either the electrophotographic type or electrostatic recording type.

In such printers, a laser beam, a light emitting diode, or a liquid crystal display is employed to produce on a charged photosensitive medium an electrostatic latent image which represents an information signal, or a recording electrode is used to produce on a dielectric medium an electrostatic latent image representing an information signal. The formed electrostatic latent image is made visible by a developing device, and the developed image is transferred onto a sheet of transfer paper. The transferred image is then fixed onto the transfer paper for achieving an observable recorded image. Such image recording is generally done in a single color, e.g., in black.

If the image is recorded in at least two colors, e.g., if calculated values or data values are recorded in a different color from that used for the format, or a portion of a drawing which is output by a CAD is in a color different from that of the remaining portion, the image will become clearer, so understanding of the contents thereof will be facilitated. In other words, recording an image at least in two colors is effective to provide quick and better comprehension of information. Accordingly, various types of electrophotographic or electrostatic recording image forming apparatus which are capable of forming an image in two colors have recently been proposed.

Among the known image forming apparatus of the above-described type, a method of forming an image using, as developing agents in two colors, two developers charged to opposite polarities is advantageous for prevention of mixture of the two colors. One example is disclosed in the specification of Japanese Patent Laid-Open No. 137538/1980. In the disclosed apparatus, a photosensitive medium which has been uniformly charged to a positive polarity is subjected to a first radiation, which represents a first information signal, so as to form a negative latent image, and the formed latent image is then reverse developed by a first positively-charged developing agent. Subsequently, the photosensitive medium is subjected to a second radiation, which represents a second information signal, so as to form a positive latent image, and the formed latent image is then normally developed by a second negatively-charged developing agent, thereby forming on the photosensitive medium first and second developed images which are charged to opposite polarities. Other examples are disclosed in the specifications of Japanese Patent Laid-Open No. 37148/1973 and Japanese Patent Laid-Open No. 81855/1979, where latent images at three different electric potential levels, i.e., an area at a predetermined reference electric potential, a first latent image at an electric potential which is lower than that of the reference potential, and a second latent image at an electric potential which is higher than that of the reference potential, are sequentially or simultaneously formed on a negatively-charged photosensitive medium. Subsequently, the first latent image is reverse developed by a first negatively-charged developing agent, and a second latent image is normally developed by a second positively-charged developing agent so as to form on the photosensitive medium first and second developed images which are charged to opposite polarities.

In either case, since the thus-formed first and second developed images have opposite polarities, they are charged by a charger prior to the transfer in such a manner that they have the same polarity, and are then transferred onto a sheet of transfer paper so as to form an image in two colors thereon.

When first and second developing agents which are charged to opposite polarities are used to form an image, the images developed by the first and second developing agents are charged in such a manner that they have the same polarity by a pre-transfer charger in the above-described manner. However, if the developing agent which is to be charged to an opposite polarity is a magnetic toner, the following disadvantage occurs: when the magnetic toner is charged by a pre-transfer charger, a magnetic substance, such as magnetite, dispersed in the magnetic toner particles leaks the charge applied by a high electric field, generating a difference in charge density between the edge portions Ta of a toner image T which are relatively easily charged and a central portion Tb which cannot be readily charged to the opposite polarity owing to the leakage of the charges, as shown in FIG. 3. Therefore, the electric field E applied during transfer is caused to concentrate at the edge portions Ta of the toner image T, and transfer failure thereby occurs at the central portion Tb of the toner image T, producing a transferred image which is hollowed at the center. This tendency to produce a non-uniform transferred image increases when the toner image consists of a line.

In the case of an image consisting of a line, image blurring also occurs due to scattering of the toner particles, prohibiting a vivid image from being produced.

SUMMARY OF THE INVENTION

Accordingly, an object of the present invention is to provide an image forming apparatus which is capable of transferring onto a transfer medium vivid images developed by at least first and second developing agents which are charged to opposite polarities.

Another object of the present invention is to provide an image forming apparatus which ensures a transferred image which is not hollowed at the center.

Still another object of the present invention is to provide an image forming apparatus which ensures a transferred image which is not blurred owing to the scattering of a developing agent.

A further object of the present invention is to provide an image forming apparatus which is capable of producing a vivid image in two colors but without mixture of the colors.

The present invention achieves the aforesaid objects by providing, in accordance with one aspect of the invention, an image forming apparatus comprising an image carrier, means for forming at least first and second latent images on the image carrier, means for developing the first and second latent images using non-magnetic and magnetic developing agents charged to opposite polarities, means for charging the first and second developed images to the same polarity as that of the charged magnetic developing agent and means for transferring the charged first and second developed images onto a transfer medium.

The foregoing and other objects and features of the present invention will become clear from the following description of the preferred embodiments taken in conjunction with the accompanying drawings.

DESCRIPTION OF THE PREFERRED EMBODIMENTS

The present invention will be hereinafter described by reference to examples which are illustrated in the accompanying drawings.

Figure 1:
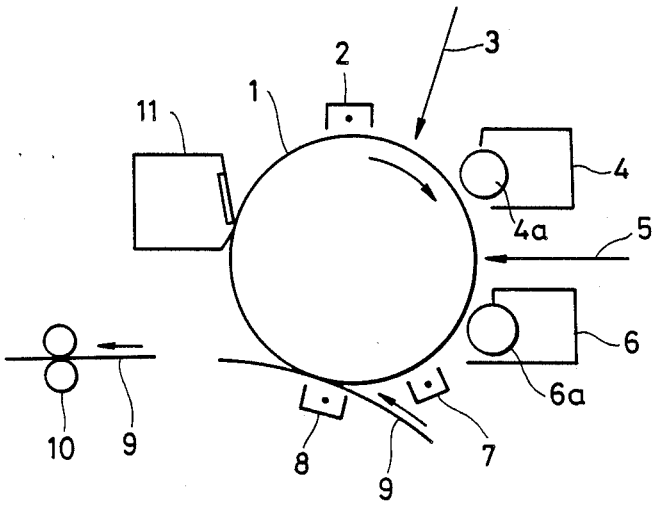
FIG. 1 is a schematic view of an image forming apparatus, showing embodiment of the present invention.
Figure 4:
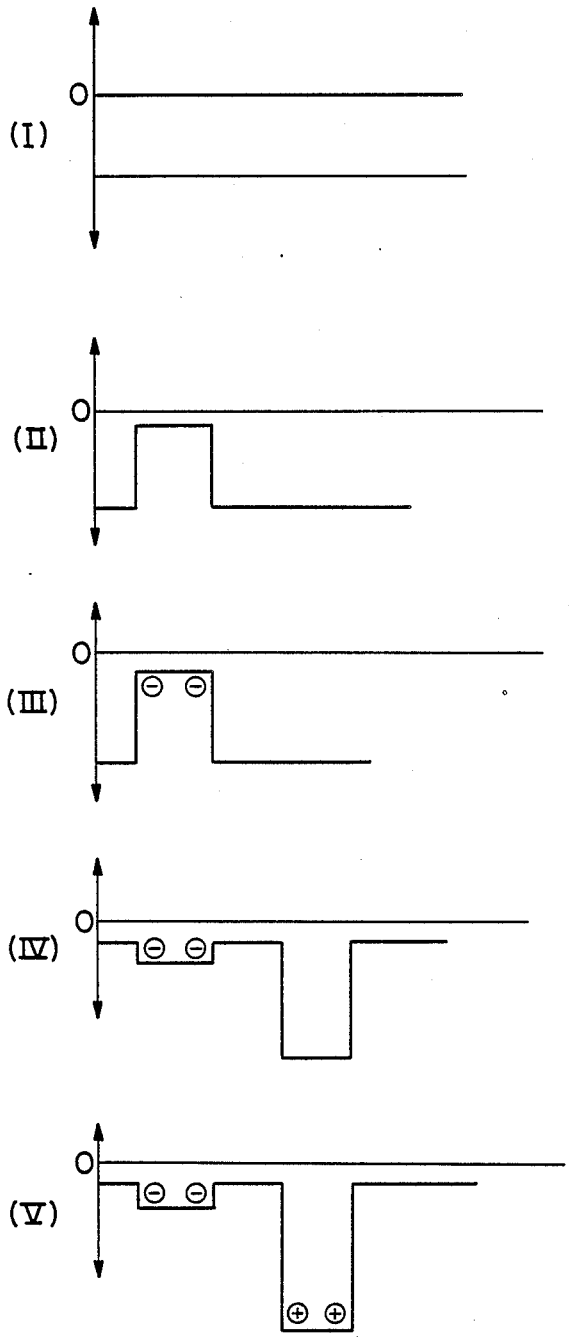
FIGS. 4(I) to (V) illustrate the change in a surface potential of a photosensitive medium in each step of a process of forming an image on the photosensitive medium by the image forming apparatus of FIG. 1.

FIG. 1 is a schematic view of a first embodiment of an image forming apparatus according to the present invention and FIG. 4 is a schematic view of the surface potential of photosensitive medium "1". A drum-shaped photosensitive medium 1 which serves as a carrier for an electrostatic latent image is mounted in such a manner as to be rotatable in the direction indicated by an arrow. The photosensitive medium 1 is uniformly charged negatively to about −800 V by a charger 2 (Step I). Reference numeral 3 designates first radiation from a first exposure means for forming on the photosensitive medium 1 a first latent electrostatic image in response to first image information (Step II). In this embodiment, the first radiation 3 comprises a first laser beam which has been modulated in response to the first image information by means of a laser modulator means. The electric potential of the portion of the photosensitive medium 1 which has been exposed by the laser beam is attenuated to about −100 V, whereby a first latent image is formed.

The first latent image is developed by a first developing device 4 (Step III). The developing device 4 contains a two-component developing agent which is composed of magnetic particles such as iron powder or ferrite and a non-magnetic toner in a chromatic color such as red which consists of a negatively-charged resin component. The developing device 4 has a developing sleeve 4a which incorporates a magnet roll and which serves as a carrier for carrying the developing agent thereon. The non-magnetic toner is supplied from the sleeve to the first latent image so as to allow it to be reverse developed, thereby forming a first toner image on the photosensitive medium 1 in a chromatic color such as red.

Reference numeral 5 denotes second radiation from a second exposure means for forming on the photosensitive medium 1 a second latent image in response to second image information (Step IV). In this embodiment, the second radiation 5 comprises a second laser beam which has been modulated in response to the second image information by a laser modulator means. The photosensitive medium 1 is background-exposed by the second laser beam 5, whereby a second latent image is formed on the medium 1.

The second latent image is developed by a second developing device 6 (Step V). The developing device 6 contains a one-component developing agent which consists of a positively-charged black magnetic toner. The developing device has a developing sleeve 6a which incorporates a magnet roll (not shown) and serves as a developing agent carrier. The magnetic toner is supplied to the second latent image on the sleeve 6a to allow it to be normally developed, thereby forming a black second toner image on the photosensitive medium 1.

The second developing device employed in this embodiment is of the non-contact jumping developing type (disclosed in the specification of U.S. Pat. No. 4,395,476) in which magnetic toner particles which are coated as a thin layer on the developing sleeve 6a are separated from the photosensitive medium by a predetermined gap, and an alternating electric field is applied in the gap so as to cause the magnetic toner particles to jump across the gap thereby causing the latent image to be developed.

A non-contact type developing method is used with the second developing device in this embodiment because the magnetic toner layer formed on the developing sleeve 6a does not make contact with the photosensitive medium 1 as the second latent image is developed. Accordingly, the first toner image which has already been formed on the photosensitive medium 1 is not scraped off, preventing development of latent images in mixed colors and also preventing a mixture of the first toner particles from going into the second developing device 6.

Moreover, the one-component magnetic toner in the second developing device does not contain separate magnetic carrier particles, unlike the two-component developer in the first developing device. Therefore, peeling-off of the first toner image caused by flying magnetic particles can be prevented.

The first and second toner images formed on the photosensitive medium 1 are uniformly charged by a corona charger 7 prior to transfer. The corona charger 7 is adapted to charge the first and second toner images to the same polarity as that of the magnetic toner (charge them positively in this embodiment), whereby the polarity of the negatively-charged first toner image (developed by the non-magnetic toner) is reversed and the first and second toner images are charged to the same positive polarity.

The first and second toner images which have been charged positively by the corona charger 7 are then transferred in one operation by means of a negatively-charged corona discharge applied by a transfer charger 8 onto a sheet of transfer paper which serves as a transfer medium and which is fed from a paper feed means (not shown).

A transfer paper sheet 9 onto which the first and second toner images have been transferred is conveyed to a fixing device 10 which is incorporated in the image forming apparatus, where the transferred first and second toner images are fixed onto the sheet of transfer paper 9 before being discharged from the image forming apparatus.

After this transfer, the residual toner particles on the photosensitive medium 1 are removed by a cleaning device 11, and the surface potential of the photosensitive medium 1 is eliminated by a charge eliminating means (not shown) so as to make it ready for a subsequent image formation.

In this invention, the first toner image (developed by the non-magnetic toner) and the second toner image (developed by the magnetic toner) which has an opposite polarity from that of the first toner image are uniformly charged by the charger prior to the transfer in such a manner that they have the same polarity as that of the magnetic toner. This is effective for the following reasons.

Figure 2:
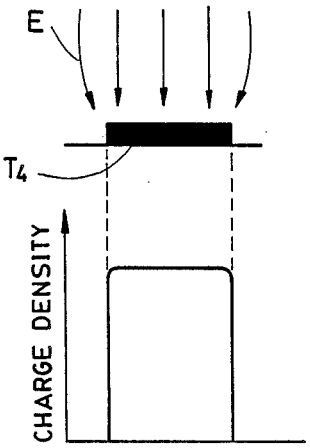
FIG. 2 illustrates the charge density on a non-magnetic toner image and the transfer electric field E acting on the toner image when the non-magnetic toner image is charged to an opposite polarity.
Figure 3:
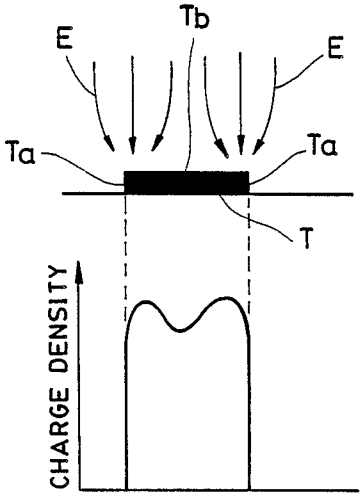
FIG. 3 the charge density on a magnetic toner image and the transfer electric field acting on the toner image when the magnetic toner image is charged to an opposite polarity, showing a comparison example of the present invention.

Since the non-magnetic toner in a chromatic color such as red is composed of a resin component alone, it has a higher resistance. Therefore, when it is charged to an opposite polarity, it can be charged sufficiently and uniformly. In consequence, even if a first toner image T4 consists of a line, as shown in FIG. 2, it can be charged at a substantially uniform charge density without generating any difference in charge density between the edge portions thereof and the central portion thereof, so that the first toner image T4 is able to hold a sufficient quantity of electric charge at the level required for transfer. On the other hand, a second toner image which is developed by a magnetic toner containing the magnetic substance remains charged to the same polarity as that to which it has been charged, so that it has a sufficient quantity of electric charge at the level required for transfer without causing any problems. As a result, the transfer electric field E generated by the transfer charger 8 acts on the first and second toner images uniformly, as shown in FIG. 2, as the toner images are tranferred onto a transfer medium, and generation of a transferred image which is hollowed at the center thereof is prevented, thus providing a transferred image in two vivid colors.

Figure 5:
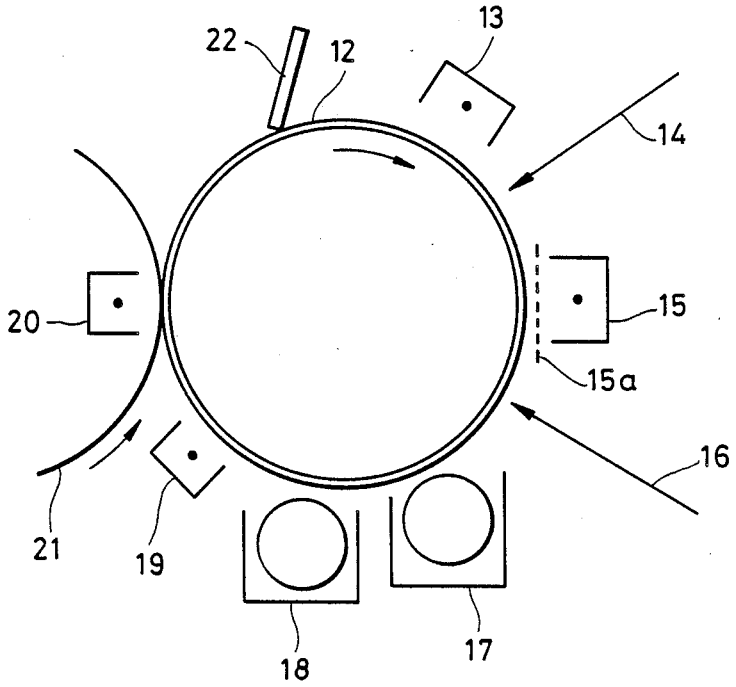
FIG. 5 is a schematic view of an image forming apparatus showing a second embodiment of the present invention.
Figure 6:
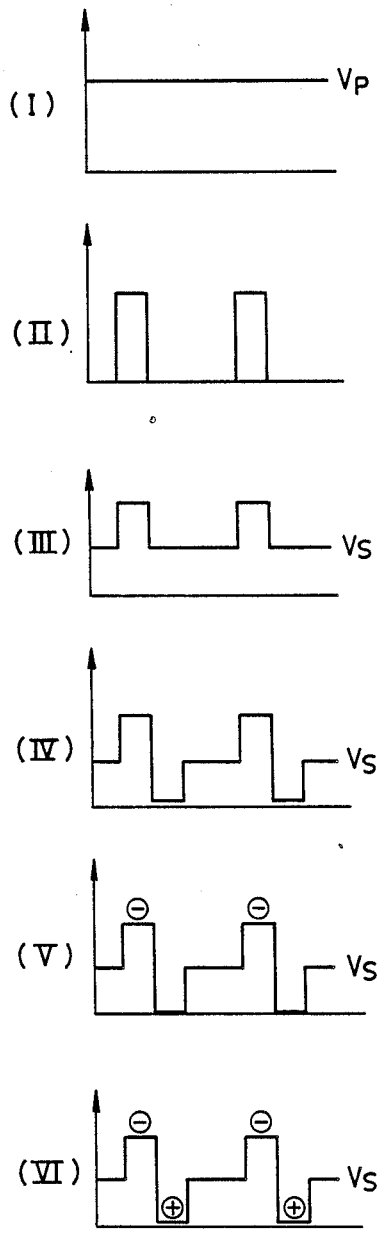
FIGS. 6 (I) to (VI) illustrate the change in a surface potential of a photosensitive medium in each step of a process of forming an image on the photosensitive medium by the image forming of FIG. 5.

Next, a second embodiment of the present invention will be described below with reference to FIGS. 5 and 6, in which FIG. 5 is a schematic view of an image forming apparatus and FIGS. 6 (I) to (VI) are schematic views of the surface potential of a photosensitive medium which serves as a carrier for an electrostatic latent image, in which the abscissa represents a position on the surface of the photosensitive medium and the ordinate represents the surface potential of the photosensitive medium.

Referring first to FIG. 5, a photosensitive medium 12 comprises what is called a drum-shaped Carlson-type photosensitive medium which has a conductive substrate and a photoconductive layer provided on the substrate. The photosensitive medium 12 is rotatable in the direction indicated by an arrow. Although any suitable photoconductive material such as Se, $ZnO_2$, or OPC can be employed as a material for the photoconductive layer, the photoconductive layer of this embodiment is made of Se.

In step (I) of an image formation process, the surface of the photosensitive medium 12 is uniformly charged by a corona discharger 13 up to the tolerance level of Se. In the example shown, the charged photosensitive medium 12 has a surface potential $V_P$ of 1000 V.

In step (II), first radiation 14 which represents a portion of a recorded image which is not to be printed in red is conducted onto the surface of the uniformly charged photosensitive medium 12. The radiation 14 is conducted at an intensity which ensures that the potential of the irradiated portion of the surface of the photosensitive medium 12 is reduced in a subsequent step (III) to a value (substantially to zero in step (II) in FIG. 6) which is less than an intermediate potential Vs. The radiation 14 comprises either a light transmitted through a document, a reflected light, a laser beam modulated in accordance with an image information signal by a modulator means, or a light spot scanned by a CRT or emitted from a light emitting element such as a light emitting diode array.

The photosensitive medium 12 onto which the first radiation 14 has been irradiated is charged to the same polarity as that of the charging conducted by the corona discharger 13 by a control corona discharger 15, i.e., to a positive polarity, whereby the portion of the surface of the photosensitive medium 12 which has been exposed in step (II) is charged to a positive intermediate potential Vs of 500 V. The control corona discharger 15 has a control grid 15*a* to which a voltage corresponding to the intermediate potential Vs is applied. The control corona discharger 15 ensures that variations in the sensitivity of the photosensitive medium 12 or variations in the intensity of the radiation are compensated for so as to provide stable and excellent image formation. The electric potential of the portion of the surface of the photosensitive medium 12 which has not been irradiated by the first radiation in the first information recording step, i.e., in step (II), remains about 1000 V, because an electric field which restricts the positive corona discharge is formed between that portion of the surface of the photosensitive medium 12 and the control grid 15*a* of the control corona discharger 15.

Subsequently, in step (IV), a second radiation 16 which represents a portion of the recorded image which is to be printed in black is irradiated on the surface of the photosensitive medium 12. At this time, the intensity of the radiation is set to a value which ensures that the potential of the irradiated portion of the photosensitive medium 12 is reduced to a sufficiently low value (to +100 V in this embodiment). The radiation 16 comprises any of the types of radiation employed for the first radiation 14.

Thus, a first latent image which is at a relatively positive potential with respect to the intermediate potential Vs and which represents an image portion to be printed in red, and a second latent image which is at a relatively negative potential with respect to the intermediate potential Vs and which represents an image portion to be printed in black, are formed on the photosensitive medium 12.

Thereafter, the first latent image is developed by a first developing device 17 in step (V), and the second latent image is developed by a second developing device 18 in step (VI).

A bias voltage corresponding to the intermediate potential Vs is applied to a developing sleeve of each of the first and second developing devices 17 and 18. The first developing device 17 employs a negatively-charged non-magnetic red toner, and the developing device 18 uses a positively-charged magnetic black toner. In consequence, the red toner particles are adhered to the first latent image in the developing step (V) by the developing device 17, and the black toner particles are adhered to the second latent image in the developing step (VI) by the developing device 18, with the portion having the intermediate potential Vs having no toner powder adhered to it.

Subsequently, the thus-developed photosensitive medium 12 is uniformly charged by a corona discharger 19 in such a manner that the toners assume the same polarity, and the toner images are then transferred onto a sheet of transfer paper 21 by a transfer corona discharger 20, whereby a recorded image is printed in two colors -black and red- on the white transfer paper sheet 21. After the transfer, the residual toner particles on the surface of the photosensitive medium 12 are removed by a cleaning blade 22 so as to make the medium ready for ensuing use.

Various experiments have been conducted on how best to carry out the above-described method of forming an image in two colors, and it has been found that the following relation exists between the conditions of charging of toners which is conducted prior to the transfer and the developing method.

The experiments conducted will be described below.

EXPERIMENTAL EXAMPLE 1

In the above-described method of forming an image in two colors, when negative pre-transfer corona discharge was conducted onto the toner image in two colors on the photosensitive medium which had been developed first by negatively-charged non-magnetic red toner and secondly by positively-charged magnetic black toner, scattering of the toner particles was observed on the black magnetic toner image, in particular, on a portion of the image represented by the periphery of thin lines. On the other hand, no blurring occurred with respect to the thin lines developed by the non-magnetic red toner. The tendency of the magnetic black toner particles to become scattered increased to a level beyond practical acceptability when the same experiment was conducted under conditions of reduced humidity. Alternatively, when positive pre-transfer corona discharge was conducted (i.e., in the same polarity as that of the magnetic black toner), blurring of the thin lines developed by the magnetic black toner was reduced to a practical level, and no scattering of the non-magnetic red toner particles which form the thin lines was observed.

From these experiments, it became apparent that the corona discharge conducted prior to transfer should be in the same polarity as that of the charged magnetic toner (i.e., a positive polarity in this embodiment).

EXPERIMENTAL EXAMPLE 2

Negatively-charged magnetic red toner was made and employed to develop the latent image portion which was developed by the non-magnetic red toner employed in Experimental Example 1. After pre-transfer corona discharge was conducted onto the thus-developed toner image formed on the photosensitive medium, toner particles were observed adhered on the photosensitive medium. At this time, development of the second latent image which was done in Experimental Example 1 was not performed, and the observation was concerned only with the magnetic red toner image on which the pre-transfer corona discharge had been conducted. When a negative pre-transfer corona discharge was used, no scattering occurred. However, a large amount of scattering was observed when the polarity of the pre-transfer corona discharge was positive.

From Experimental Example 1 and Experimental Example 2, it became apparent that magnetic toner particles could be readily scattered by the pre-transfer corona discharge, and that it was desirable for the polarity of the pre-transfer corona discharge to be identical with that of the charged magnetic toner in the above-described method of forming an image in two colors.

EXPERIMENTAL EXAMPLE 3

Under the condition that the positively-charged magnetic toner particles are scattered by the negative pre-transfer corona discharge in Experimental Example 1, the magnet roller in the developing sleeve of the developing device 18, containing magnetic toner was removed, and the latent image was formed so that no magnetic field was generated between the photosensitive medium and the developing area of the developing sleeve. When the toner particles were observed adhered on the photosensitive medium, blurring of the thin lines was at a minimum, although the image was unsatisfactory from the viewpoint of disjointedness and fogging.

Accordingly, from the Experimental Examples, it was found that blurring of the thin lines often occurs when magnetic toner is employed for development in a magnetic field.

Figure 7:
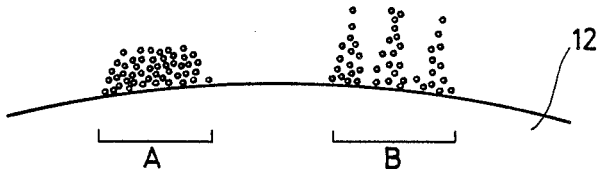
FIG. 7 is an enlarged schematic view showing the disposition of non-magnetic and magnetic toner particles on the surface of the photosensitive medium.

It is conjectured that the reason why the magnetic toner image placed in the magnetic field is readily blurred by pre-transfer corona discharge whereas non-magnetic toner particles are not easily scattered by such discharge may be explained as follows:

FIG. 7 is an enlarged schematic view of the state of toners adhered to the photosensitive medium, in which reference symbol A designates non-magnetic toner particles, and symbol B denotes magnetic-toner particles. Whereas the non-magnetic toner particles A closely adhere to the photosensitive medium and tend to lie flat, the magnetic-toner particles B adhere to the photosensitive medium in a chain-like fashion. This is because the magnetic toner particles B are stacked on top of each other along the lines of the magnetic field generated in the developing area. The particles are conveyed to the photosensitive medium in the chain-like fashion, and remain in that state since the photosensitive medium is not scraped in the non-contact developing method.

On the other hand, in development with non-magnetic toner or with magnetic toner with no magnetic field applied, the toner particles are not stacked on top of each other and are caused to lie flat on the photosensitive medium without scattering. Further, when the toner particles on the photosensitive medium enter a pre-transfer charger area, stacked toner particles are easily scattered due to the action of a so-called corona wind which flows from the charger toward the photosensitive medium. At this time, if the polarities of the corona and toner particles are opposite, the toner particles which are located on the top of the stack and are charged to an opposite polarity, are repulsed by the latent image portion, and are easily attached to the non-latent image portion, causing a scattering. In particular, toner particles are readily moved when the humidity is low, thus increasing the scattering effect.

The results of the above-described experiments and examinations lead to the conclusion that, in a method of forming an image in two colors, it is preferable to employ a non-contact developing method for the second development so as to prevent color mixture, and that a thin line of better quality is reproduced by charging both toners to the same polarity as that of the charged magnetic toner prior to transfer, provided that the polarities of the first and second developing toners are opposite and the non-contact developing method is used for the second development.

When image formation was conducted by the image forming apparatus of FIG. 5 on the basis of the above-described conclusions by adopting non-contact development for the second development performed by the second developing device 18 and by charging both toners to the same polarity as that of the magnetic black toner by means of the corona discharger 19, an image in two vivid colors which exhibited no thin line blurring was obtained.

In this embodiment, the developing agent employed in the first development consisted of the non-magnetic toner alone. However, as in the first embodiment, it may alternatively be a two-component developing agent which is composed of a non-magnetic toner and magnetic particles. In either case, what actually adheres to and develops the first latent image is the non-magnetic toner.

In the first and second embodiments, although no reference has been made to the developing method adopted for the first developing device, any known contact or non-contact development method may be employed.

Further, in the first and second embodiments, a latent image is formed on a charged photosensitive medium with the aid of radiation. However, it may also be formed by utilizing an electrostatic recording process in which an electrostatic latent image is formed on a dielectric layer without the aid of radiation.

As will be understood from the foregoing description, in accordance with the present invention, at least first and second developed images which have been developed by opposite polarity non-magnetic and magnetic developing agents are charged to the same polarity as that of the charged magnetic developing agent before they are transferred onto a transfer medium, thereby forming an image in at least two vivid colors.

What is claimed is:

1. An image forming apparatus comprising:

a movable image carrier;

means for forming on said image carrier at least first and second latent images corresponding to image information;

a first developing device for developing said first latent image with non-magnetic toner charged to a predetermined polarity;

a second developing device disposed downstream of said first developing device with respect to the movement direction of said image carrier for developing said second latent image with one-component magnetic toner charged to a polarity opposite to the predetermined polarity, said second developing device including a toner carrier which is coated with a thin layer of said magnetic toner and is spaced from said image carrier to provide a gap between the surface of said image carrier and said thin layer of magnetic toner, a magnetic member disposed within said toner carrier, and means for applying an electric field across the gap to cause said magnetic toner to jump from said toner carrier onto said second latent image;

pre-transfer charging means for charging said first and second toner images developed by said non-magnetic and magnetic toners, respectively, to the same polarity as that of said magnetic toner before transfer; and means for transferring said charged first and second toner images onto a transfer medium.

2. An image forming apparatus according to claim 1, wherein said first developing device contains two-component developing agent which is composed of said non-magnetic toner and magnetic particles.

3. An image forming apparatus according to claim 1, wherein said latent image forming means includes a first charging means for charging said image carrier to a predetermined polarity, first radiation means for irradiating said charged image carrier with first radiation corresponding to first image information, and second radiation means for irradiating said image carrier on which said first radiation has been irradiated with second radiation corresponding to second image information.

4. An image forming apparatus according to claim 3, wherein said first latent image is formed on said image carrier by said first radiation means, and said second latent image is formed on said image carrier by said second radiation means after said first latent image has been developed.

5. An image forming apparatus according to claim 3, including a second charging means for charging said image carrier to the same polarity as that of the charging conducted by said first charging means after said first radiation has been irradiated but before said second radiation is irradiated onto said image carrier.

6. An image forming apparatus according to claim 1, wherein said first and second toner images are in different colors.

7. An image forming apparatus according to claim 6, wherein said first toner image is developed by said non-magnetic toner in a chromatic color, and said second toner image is developed by said magnetic toner in black.

8. An image forming apparatus according to claim 3, wherein said image carrier is exposed with said first radiation at a portion corresponding to an image portion of said first image information and is exposed with said second radiation at a portion corresponding to a background portion of said second image information.

9. An image forming apparatus according to claim 8, wherein the first latent image formed by said first radiation is reverse developed and the second latent image formed by said second radiation is normally developed.

10. An image forming apparatus according to claim 5, wherein said image carrier is exposed with said first radiation at a portion corresponding to a background portion of said first image information and is exposed with said second radiation at a portion corresponding to an image portion of said second image information.

11. An image forming apparatus according to claim 10, wherein the first latent image formed with said first radiation is normally developed and the second latent image formed with said second radiation is reverse developed.

12. An image forming apparatus according to claim 5, wherein said second charging means includes a control grid in facing relationship to said image carrier.

13. An image forming method comprising the steps of:

forming first and second latent images corresponding to image information on a movable image carrier;

developing the first latent image with a first developing device containing non-magnetic toner charged to a predetermined polarity;

developing the second latent image with a second developing device containing magnetic toner charged to a polarity opposite to the predetermined polarity by spacing a thin layer of the magnetic toner formed on a toner carrier from the surface of said image carrier by a gap and applying an electric field across the gap to cause the magnetic toner to jump from the toner carrier to the second latent image, wherein the second developing device is located downstream of the first developing device with respect to the moving direction of the image carrier;

charging the first and second developed images developed by the non-magnetic and magnetic toners, respectively, to the same polarity as that of the magnetic toner before transfer; and transferring the charged first and second developed images onto a transfer medium.

14. An image forming method according to claim 13, wherein the non-magnetic toner is mixed with magnetic carrier particles.

15. An image forming method according to claim 13, wherein said image forming step includes a first charging step for charging the image carrier to a predetermined polarity, a first radiation step for irradiating the charged image carrier with first radiation corresponding to first image information, and a second radiation step for irradiating the image carrier on which the first radiation has been irradiated with second radiation corresponding to second image information.

16. An image forming method according to claim 15, wherein the second radiation step is performed after the first latent image has been developed.

17. An image forming method according to claim 16, wherein said image forming step further comprises a second charging step for charging the image carrier to the same polarity as that of the first charging step after the first radiation step but before the second radiation step.

18. An image forming method according to claim 13, wherein the first latent image is developed by the non-magnetic toner in a chromatic color, and the second latent image is developed by the magnetic toner in block.

19. An image forming method according to claim 15, wherein the image carrier is exposed with the first radiation at a portion of the first image information and is exposed with the second radiation at a portion corresponding to a background portion of the second image information.

20. An image forming method according to claim 19, wherein the first latent image formed with the first radiation is reverse developed and the second latent image formed with the second radiation is normally developed.

21. An image forming method according to claim 17, wherein the image carrier is exposed with the first radiation at a portion corresponding to a background portion of the first image information and is exposed with the second radiation at a portion corresponding to an image portion of the second image information.

22. An image forming method according to claim 21, wherein the first latent image formed with the first radiation is normally developed and the said second latent image formed with the second radiation is reverse developed.

23. An image forming apparatus according to claim 1, wherein said applying means applies an alternating electric field.

24. An image forming apparatus according to claim 1, wherein said charged first and second toner images are transferred at the same time onto the transfer medium.

25. A method according to claim 13, wherein an alternating electric field is applied to effect development of the second latent image.

26. A method according to claim 13, wherein the charged first and second toner images are transferred at the same time onto the transfer medium.

* * * * *

UNITED STATES PATENT AND TRADEMARK OFFICE

CERTIFICATE OF CORRECTION

PATENT NO. : 4,937,630

DATED : June 26, 1990

INVENTOR(S) : MASAO YOSHIKAWA ET AL.

It is certified that error appears in the above-identified patent and that said Letters Patent is hereby corrected as shown below:

ON TITLE PAGE:

AT [56] REFERENCES CITED

Foreign Patent Documents should read as follows:

--48-37148 6/1973 Japan .
54-81855 6/1979 Japan .
55-13758 10/1980 Japan .
56-144452 11/1981 Japan .--.

COLUMN 3

Line 20, "embodiment" should read --a first embodiment--.
Line 41, "image forming" should read --image forming apparatus--.

COLUMN 12

Line 14, "block." should read --black.--.
Line 34, "said" should be deleted.

Signed and Sealed this

Twenty-first Day of July, 1992

*Attest:*

DOUGLAS B. COMER

*Attesting Officer*

*Acting Commissioner of Patents and Trademarks*